US007902958B2

(12) United States Patent
Kahr

(10) Patent No.: US 7,902,958 B2
(45) Date of Patent: Mar. 8, 2011

(54) RESISTOR ELEMENT WITH PTC PROPERTIES AND HIGH ELECTRICAL AND THERMAL CONDUCTIVITY

(75) Inventor: Werner Kahr, Deutschlandsberg (AT)

(73) Assignee: EPCOS AG, Munich (DE)

( * ) Notice: Subject to any disclaimer, the term of this patent is extended or adjusted under 35 U.S.C. 154(b) by 12 days.

(21) Appl. No.: 12/356,270

(22) Filed: Jan. 20, 2009

(65) Prior Publication Data

US 2009/0179730 A1 Jul. 16, 2009

Related U.S. Application Data

(63) Continuation of application No. PCT/DE2007/001293, filed on Jul. 19, 2007.

(30) Foreign Application Priority Data

Jul. 20, 2006 (DE) ..... 10 2006 033 691

(51) Int. Cl.
*H01C 10/00* (2006.01)

(52) U.S. Cl. ..... 338/195

(58) Field of Classification Search ..... 338/204, 338/310, 320, 319, 314, 239, 195
See application file for complete search history.

(56) References Cited

U.S. PATENT DOCUMENTS

| | | | | | |
|---|---|---|---|---|---|
| 4,179,797 | A | * | 12/1979 | Johnson | 29/610.1 |
| 4,314,230 | A | * | 2/1982 | Cardinal et al. | 338/314 |
| 4,529,958 | A | * | 7/1985 | Person et al. | 338/275 |
| 4,544,828 | A | | 10/1985 | Shigenobu et al. | |
| 5,081,439 | A | * | 1/1992 | Natzle et al. | 338/195 |
| 5,153,554 | A | * | 10/1992 | Becker et al. | 338/21 |
| 5,397,518 | A | | 3/1995 | Shukla et al. | |
| 5,796,568 | A | | 8/1998 | Baiatu | |
| 5,939,972 | A | * | 8/1999 | Nagao et al. | 338/22 R |
| 5,953,811 | A | | 9/1999 | Mazzochette | |
| 6,094,129 | A | * | 7/2000 | Baiatu | 338/22 R |
| 6,100,787 | A | * | 8/2000 | Huang et al. | 338/204 |
| 6,323,751 | B1 | * | 11/2001 | Duggal et al. | 338/22 R |
| 7,286,039 | B2 | | 10/2007 | Yoneda | |
| 2002/0089065 | A1 | | 7/2002 | Fujimoto et al. | |

FOREIGN PATENT DOCUMENTS

| | | |
|---|---|---|
| DE | 8309023 | 2/1986 |
| DE | 44 41 279 C1 | 9/1995 |
| DE | 100 05 800 A1 | 2/2001 |
| EP | 0 184 645 B1 | 6/1986 |
| JP | 9-129408 A | 5/1997 |
| WO | WO 2005/027150 A1 | 3/2005 |

* cited by examiner

*Primary Examiner* — Kyung Lee
(74) *Attorney, Agent, or Firm* — Slater & Matsil, L.L.P.

(57) ABSTRACT

A resistor element with a ceramic body that has PTC properties is specified. At least one main surface of the ceramic body has an arrangement of depressions.

21 Claims, 2 Drawing Sheets

21
61
1
10

22
62
21
61
1

22
62
21
61
1

22
62
21
61
1

62
21
61
1

22
62
21
61
1

22
62

RESISTOR ELEMENT WITH PTC PROPERTIES AND HIGH ELECTRICAL AND THERMAL CONDUCTIVITY

This application is a continuation of co-pending International Application No. PCT/DE2007/001293, filed Jul. 19, 2007, which designated the United States and was not published in English, and which claims priority to German Application No. 10 2006 033 691.7 filed Jul. 20, 2006, both of which applications are incorporated herein by reference.

BACKGROUND

An arrangement with particles of PTC material that are distributed in a binder is known from German patent publication DE 3107290 A1. A flexible element in ribbon form is known from German patent publication DE 8309023 U1.

SUMMARY

In one aspect, the present invention specifies a resistor element that is characterized by high electrical and thermal conductivity.

For example, a resistor element with a ceramic body of ceramic that has PTC properties is specified. The abbreviation PTC stands for "positive temperature coefficient." At least one main surface of the ceramic body has an arrangement of depressions.

Preferably, the first main surface of the ceramic body has an arrangement of first depressions and the second main surface of the ceramic body has an arrangement of second depressions.

The main surfaces of the ceramic body, including the surface of the depressions, are preferably coated with an electrode layer. Each electrode layer forms an electrode surface. The resistance of the resistor element will be lower, the greater the electrode surface and the smaller the distance between the electrode layers. These parameters are directly dependent on geometric parameters such as the depth and width of the depressions and the distance between the depressions. By adjusting the electrode area and the spacing between electrode layers as illustrated below, it is possible to achieve a specified resistance value for the specified size of the resistor element.

Through the depressions it is possible, in particular, to enlarge the effective electrode surface of the ceramic body and thus to lower the resistance value of the resistor element compared to a design without depressions. Through the depressions it is additionally possible to reduce the distance between two oppositely lying electrode surfaces of the resistor element. Through the increase of the electrode surface it is also possible to achieve an especially small resistor element with high heat dissipation. Low resistances and high heat dissipation are also achieved by small spacings of the depressions.

The first (and second) depressions preferably have the shape of slots or grooves that run parallel to each other. However, the depressions can also be designed as blind holes. A regular arrangement of uniformly designed depressions is preferred.

The second depressions can run parallel to the first depressions. However, the second depressions can also run across, in particular, perpendicularly or obliquely, to the first depressions.

The depressions can have any cross section. In particular, the side walls of the depressions can run perpendicularly or obliquely to the main surfaces of the resistor element or can be curved. The depressions can also have steps.

The depth of the depressions preferably is greater than their width. The depth of the depressions can, for example, be at least twice the width. The depth of the depressions is preferably at least 20% of the thickness of the ceramic body. The depth of the depressions can even exceed 50% of the thickness of the ceramic body. The first and second depressions can have the same depth. However, in principle, they can also have depths that differ from each other.

In an advantageous variation, the second depressions are staggered with respect to the first depressions (in a top view). In this case the ceramic body has a serpentine cross section. In this variation it is possible to form particularly deep depressions, the depth of which can exceed half the thickness of the ceramic body.

The staggered first and second depressions can overlap with respect to the direction of the thickness of the ceramic body (in a side view) so that they intermesh in a central region of the ceramic body. In this case, the first and second depressions are alternatingly arranged in the central region of the ceramic body. The depth of the depressions in this case exceeds half the thickness of the ceramic body.

In another variation, the second depressions can (in a top view) lie opposite the first depressions. In this case, the depth of the first and second depressions will be smaller than half the thickness of the ceramic body.

The depressions can at least partially be filled with a filler material, whose thermal conductivity exceeds that of the material of the ceramic body. In this way it is possible to create heat sinks in the ceramic body which improve the dissipation of heat of the resistor element to the environment, i.e., to an object.

The filler material can be an electrically insulating material. However, the filler material can also be electrically conductive.

The ceramic body is preferably a solid, rigid, sintered body. $BaTiO_3$ is suitable as the base material for the ceramic body. The ceramic body is preferably made as a plate. The depressions can be produced in a sintered ceramic body as indentations. After the formation of the depressions, the main surfaces of the ceramic body are metalized to form the electrode layers. However, there is also the possibility of making the depressions in a ceramic body that has not yet been sintered and to subject the ceramic body to sintering with the depressions already formed.

The electrode layers can in each case be deposited, for example, in an electrolytic process. However, they can also be applied by sputtering, evaporation or as a metal paste and fired onto the ceramic body. Combinations of these electrode technologies are also possible to produce particular sequences of layers.

Resistor elements put together in this way are preferably provided with electrical terminals for supply of current, where the mechanical design can correspond to any radially contacted or SMD-capable element. The formation of these elements can also involve coating with insulating materials or encapsulation in plastics. A number of resistor elements can be encapsulated together. These resistor elements can also be combined with at least one cover layer that lies flush, the thermal conductivity of which preferably exceeds that of the material of the ceramic body. This cover layer can be electrically conductive and can be suitable as a contact for the supply of current. The cover layer can also be designed as a composite that includes an electrically conductive partial layer and an electrically insulating partial layer.

The resistor elements can also be arranged without a premade connection to the cover layers so that the electrical and thermal contact to these layers can also take place later. A number of resistor elements mechanically connected to each other can be used together in one arrangement. These resistor elements are preferably electrically connected to each other.

BRIEF DESCRIPTION OF THE DRAWINGS

The resistor element will now be explained by means of drawings, which are schematic and not to scale. Here:

FIG. 5, shows various examples of the arrangement of the depressions.

Figure 1:
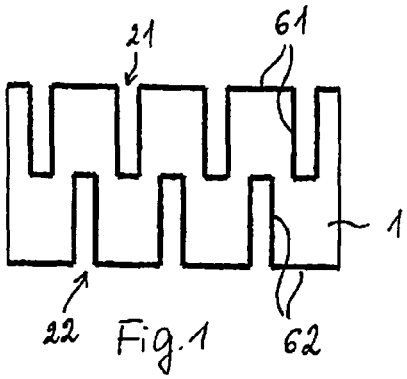
FIG. 1 shows a resistor element with an arrangement of depressions on the two main surfaces of the ceramic body.

The following list of reference symbols can be used in conjunction with the drawings:

1, 1*a*, 1*b* Ceramic body
10 Central region of ceramic body
21 First depressions
22 Second depressions
3 Filler material
41 First cover layer
42 Second cover layer
51, 52 Electrical terminal
61 First electrode layer
62 Second electrode layer

DETAILED DESCRIPTION

FIG. 1 shows a resistor element with a ceramic body 1. The ceramic body 1 has first depressions 21, which are arranged on the first main surface (top), and second depressions 22, which are arranged on the second main surface (bottom). As in the variation in FIG. 2, these depressions are preferably filled with a filler material 3, which has better thermal conductivity than ceramic body 1.

A first electrode layer 61 is arranged on the top of the ceramic body and a second electrode layer 62 is arranged on the bottom. The electrode layers 61 and 62 also coat the surface of the depressions 21 and 22.

Figure 2:
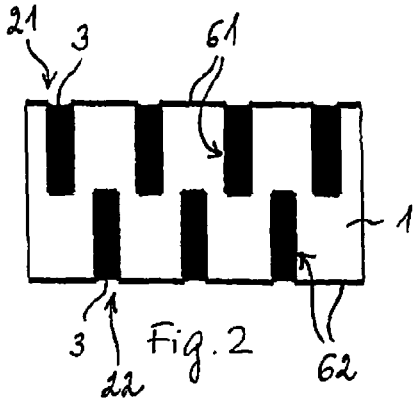
FIG. 2 shows the resistor element as in FIG. 1 with the depressions filled with a filler.
Figure 3:
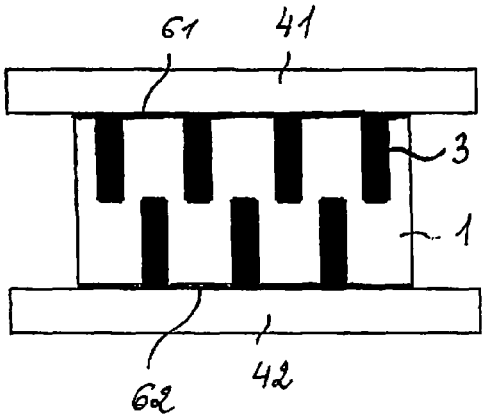
FIG. 3 shows the resistor element as in FIG. 2, which is arranged between two cover layers.

The second depressions 22 are laterally offset, or staggered, with respect to the first depressions 21. The first and second depressions 21 and 22 are not connected to each other. The depth of the depressions 21 and 22 shown in FIGS. 1 to 3 is preferably roughly half the thickness of the ceramic body 1. A design of the depressions 21 and 22 with this sort of depth is particularly possible when:

a) the distance between two successive first depressions is greater than the width of the second depressions; and b) the distance between two successive second depressions is greater than the width of the first depressions.

Other variations of depressions 21 and 22 with respect to depth and shape are illustrated in FIGS. 5A through 5F.

In the variation in FIG. 3 the ceramic body 1 is arranged between two cover layers 41 and 42. The ceramic body 1 is preferably firmly bonded to the cover layers 41 and 42, for example, glued.

The resistor element shown in FIGS. 1 to 3 is suitable for use, for example, as a heating element.

Figure 4:
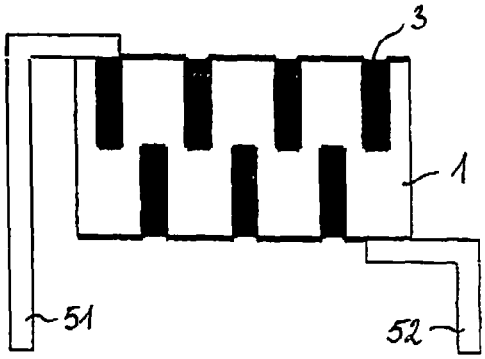
FIG. 4 shows the resistor element as in FIG. 2 in an SMD embodiment.

FIG. 4 shows the resistor element in accordance with FIG. 2, having electrical terminals 51 and 52 extended to the bottom of the resistor element. Such a resistor element is a surface-mountable element or SMD element. The abbreviation SMD stands for "surface mounted device." The resistor element shown in FIG. 4 can be mounted on a circuit board and is a possibility, in particular, for current protection applications.

The resistor element can alternatively be designed as a wired element, i.e., with wire terminals.

Figures 5A, 5B, 5C, 5D, 5E, 5F:
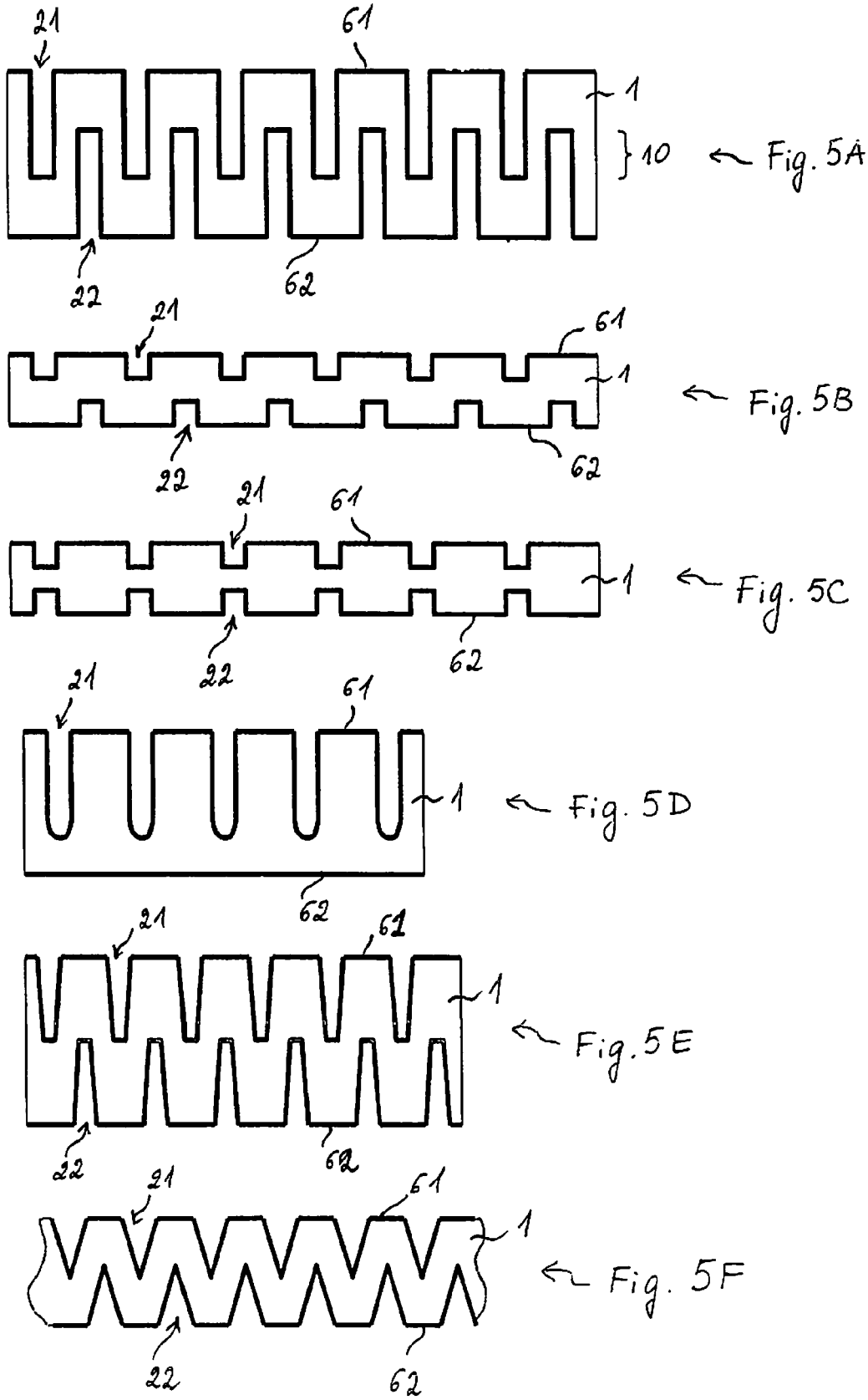
FIGS. 5A-5F, collectively

The depth of the depressions 21 and 22 shown in FIG. 5A is greater than half the thickness of the ceramic body 1, so that the first depressions partially intermesh and overlap in a central region 10 of the ceramic body. As in the variation in accordance with FIG. 1 the ceramic body has a serpentine cross section.

Depressions 21 and 22 that are especially deep have the advantage that this results in an especially small distance between the electrode layers 61 and 62 and thus the resistance of the resistor element can be reduced.

The depth of the depressions 21 and 22 shown in FIGS. 5B and 5C is set to be smaller than half the thickness of the ceramic body 1. In 5C the second depressions 22 lie directly opposite the first depressions 21. The remaining thickness of the ceramic body between depressions 21 and 22 is selected so that it is sufficient for stability of the resistor element.

FIG. 5D shows a resistor element that has an arrangement of depressions 21 only on one side.

The depressions 21 and 22 of the resistor elements shown in FIGS. 1 through 5C have a rectangular cross section. The cross section of the depressions 21 and 22 can, alternatively, be rounded as in FIG. 5D, have obliquely running side walls as in FIG. 5E, or be V-shaped as in FIG. 5F.

What is claimed is:

1. A resistor element comprising:

a ceramic body that has positive temperature coefficient (PTC) properties;

wherein a first main surface of the ceramic body has an arrangement of first depressions;

wherein a second main surface of the ceramic body has an arrangement of second depressions, the second main surface opposed to the first main surface; and wherein the ceramic body comprises a unitary body, wherein the first depressions do not extend to the second main surface and wherein the second depressions do not extend to the first main surface.

2. The resistor element according to claim 1, wherein the second depressions are staggered with respect to the first depressions.

3. The resistor element according to claim 2, wherein the first and second depressions overlap with respect to a distance between the first and second main surfaces of the ceramic body so that they intermesh.

4. The resistor element according to claim 1, wherein the depressions each have a depth that amounts to at least 20% of the thickness of the ceramic body.

5. The resistor element according to claim 1, further comprising an electrode layer overlying the first main surface of the ceramic body.

6. The resistor element according to claim 1, wherein the depressions are filled with a filler material with a thermal conductivity greater than that of a material of the ceramic body.

7. The resistor element according to claim 1, wherein at least one main surface of the ceramic body is joined to a cover layer with a thermal conductivity that is greater than that of the ceramic body.

8. The resistor element according to claim 1, wherein at least one main surface of the ceramic body is firmly joined to an electrical terminal.

9. The resistor element according to claim 8, wherein the ceramic body with the electrical terminal joined to it is surrounded by a cover layer.

10. The resistor element according to claim 1, wherein the resistor element is mechanically and electrically joined to at least one additional resistor element.

11. The resistor element according to claim 1, wherein the depressions have a rectangular cross-section.

12. The resistor element according to claim 1, wherein the depressions have a rounded cross-section.

13. The resistor element according to claim 1, wherein the depressions have sidewalls extending in a direction that is not perpendicular to the first main surface.

14. A resistor element comprising:

a unitary ceramic body with positive temperature coefficient (PTC) properties, the ceramic body having a first main surface and a second main surface that is opposed to the first main surface;

a plurality of first depressions within the first main surface of the ceramic body, the first depressions not extending to the second main surface;

a plurality of second depressions within the second main surface of the ceramic body, the second depressions not extending to the first main surface;

a first electrode electrically and physically connected to the ceramic body; and a second electrode electrically and physically connected to the ceramic body.

15. The resistor element according to claim 14, wherein the first electrode is physically connected to the first main surface and the second electrode is physically connected to the second main surface.

16. The resistor element according to claim 14, further comprising a filler material filling the first and second depressions.

17. The resistor element according to claim 16, wherein the filler material has a thermal conductivity that is greater than a thermal conductivity of the ceramic body.

18. The resistor element according to claim 14, wherein the second depressions are staggered with respect to the first depressions.

19. The resistor element according to claim 18, wherein the first and second depressions overlap with respect to a distance between the first and second main surfaces of the ceramic body so that they intermesh.

20. A resistor element comprising:

a ceramic body that has positive temperature coefficient (PTC) properties;

wherein a first main surface of the ceramic body has an arrangement of first depressions;

wherein a second main surface of the ceramic body has an arrangement of second depressions, the second main surface opposed to the first main surface; and wherein the second depressions are staggered with respect to the first depressions.

21. The resistor element according to claim 1, wherein the first and second depressions overlap with respect to a distance between the first and second main surfaces of the ceramic body so that they intermesh.

* * * * *

UNITED STATES PATENT AND TRADEMARK OFFICE

CERTIFICATE OF CORRECTION

PATENT NO. : 7,902,958 B2
APPLICATION NO. : 12/356270
DATED : March 8, 2011
INVENTOR(S) : Kahr It is certified that error appears in the above-identified patent and that said Letters Patent is hereby corrected as shown below:

In Col. 6, line 28, claim 21, delete "claim 1" and insert --claim 20--.

Signed and Sealed this
Tenth Day of May, 2011

David J. Kappos

David J. Kappos
*Director of the United States Patent and Trademark Office*